United States Patent [19]

Kupperman et al.

[11] 4,031,656

[45] June 28, 1977

[54] PLASTIC TOY INTEGRALLY FORMED AND MOLDED WITH A PROPELLER AND MEANS FOR ATTACHING THE TOY TO A SUPPORT MEMBER

[75] Inventors: Sam Kupperman, Chicago; Dennis I. Kupperman, Glenview, both of Ill.

[73] Assignee: R B Toy Development Co., Skokie, Ill.

[22] Filed: Apr. 19, 1976

[21] Appl. No.: 677,919

[52] U.S. Cl. ..... 46/53; 40/37.1; D10/59; D34/15 R

[51] Int. Cl.[2] ..... A63H 33/40

[58] Field of Search ..... 46/41, 44, 53, 58; 40/37, 37.1; D10/59; D34/15

[56] References Cited

UNITED STATES PATENTS

| | | | |
|---|---|---|---|
| 1,794,576 | 3/1931 | Bott | 46/53 |
| 1,824,003 | 9/1931 | Wilson | 40/37.1 |
| 2,497,527 | 2/1950 | Bacon | 46/53 |

*Primary Examiner*—Louis G. Mancene
*Assistant Examiner*—Mickey Yu
*Attorney, Agent, or Firm*—Vogel, Dithmar, Stotland, Stratman & Levy

[57] ABSTRACT

A plastic toy integrally formed and molded in an injection molding machine and comprising a relatively thin body portion, a propeller with angled blades and a ring-like member as part of the body portion in which the propeller is manually detachable from the integrally formed toy unit and is mounted for rotation with respect to said body portion. The ring-like member has a thickness or width closely approximating that of the thin body portion and with lateral extensions on said ring-like member. The ring-like member permits securement of said toy unit on a support, such as the bars of a bicycle or tricycle so that the forward movement of the unit will cause said propeller to rotate with respect to the body portion.

10 Claims, 4 Drawing Figures

PLASTIC TOY INTEGRALLY FORMED AND MOLDED WITH A PROPELLER AND MEANS FOR ATTACHING THE TOY TO A SUPPORT MEMBER

BRIEF SUMMARY OF THE INVENTION

One of the objects of this invention is to provide an integrally formed, plastic molded toy unit formed with a body portion, a propeller and means for attaching it to a support member, such as a handle bar, said toy being inexpensively produced so that it may be packaged with cereals and other like food products and given away as a premium without appreciably adding to the cost of the packaged product.

Another object of this invention is to provide an integrally formed plastic toy in the form of an airplane formed with an angled propeller, which propeller may be readily broken off from the rest of the toy and slipped on that portion of the toy forming the front shaft so that the propeller may rotate relative to the toy body.

Another object of this invention is to provide a toy integrally formed of plastic in an injection molding machine in which the parts, including the propeller, are formed as an integral part of the unit, with the propeller adapted to be broken away from the other part so that it may operate as a propeller.

Another object of this invention is to provide a plastic toy utilizing very little plastic material, all integrally molded with a propeller having angled blades and with a toy body having outwardly extending wings and in which the opposite edges of the blades of the propeller are in the same vertical plane as the opposite edges of the wings. This provides an action toy with a rotatable propeller and provides a three-dimensional effect.

BRIEF DESCRIPTION OF THE DRAWINGS

FIG. 3 shows same with the propeller broken away from the integral unit of FIG. 1 and mounted on the front extension or shaft of the unit with the unit mounted on the handle bar of a tricycle or the like.

DESCRIPTION OF THE PREFERRED EMBODIMENTS

Figure 1:
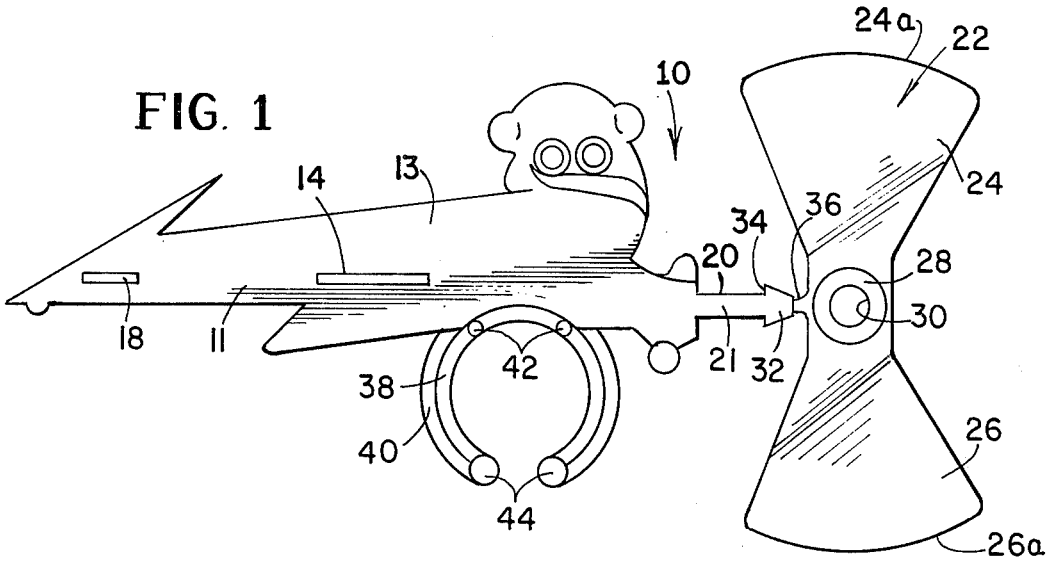
FIG. 1 is a view of the integrally formed toy as same is molded as an integral unit.

The entire toy unit is integrally molded in and ejected in a single shot operation from a plastic injection molding machine. Said entire toy unit is generally indicated by the numeral 10 and is shown in its integral form in FIGS. 1 and 2. The plastic material is preferably polypropylene or polyethylene. It comprises a body portion generally indicated at 12 which, in the illustration shown, is intended to simulate an airplane although any other figure may be formed. The body portion 11 comprises a relatively thin wall and is substantially rigid. The thickness or width of the thin wall is indicated at 12. Extending from the opposite sides of the body portion are simulated fixed wings 14 with the outer edges of each of the wings designated as 16. The tail portion of the body 11 is provided with laterally extending fixed simulated rudders 18. Formed integrally with the body portion 11 and extending forwardly thereof is an extension generally indicated at 20 which is substantially rigid and formed as part of said extension is a substantially rigid propeller generally indicated at 22 provided with a pair of oppositely angled blades 24 and 26 and a central hub 28. The hub has an annular opening 30. The front end of the extension 20 is shaped in the form of an arrow head 32 and provides a shoulder 34. Between the arrow head 32 of the extension 20 and the blade 22 there is a weakened connecting portion designated at 36 so that the propeller may be broken off from the extension merely by manually twisting the propeller with respect to the extension 20.

Formed integrally with the body portion 11 and extending downwardly thereof is a split ring generally indicated at 38. The width or thickness of the split ring 38 is slightly more than the thickness 12 of the body member 11 so that a minimum of plastic material is used. The split ring 38 is reinforced by a rib 40 for rigidifying the split ring. To support the unit against wobbling when mounted on the handle bar there is provided and formed integrally with the split ring 38 laterally extending spaced pins 42 which extend from the opposite sides of the split ring with a pair of pins on each side. The laterally extending pins 42 are adjacent the top of the ring and provide support for the toy after same has been mounted on the handle bar. Due to the narrow width of the split ring 38 the toy might wobble with respect to the handle bar; however, the laterally extending pins 42 will prevent this as they provide a widened support area. The split ring 38 has spaced ends adjacent the split which are shaped to form end bosses 44. The toy unit may be readily secured to the handle bar 46 of a tricycle or the like or may be secured to a rod of circular cross section by pressing down at the split portion of the ring 38 which will cause the split ring 38 to expand and encircle a portion of the handle bar or rod and be retained thereon.

Before mounting the toy on the handle bar or rod, the propeller 22 is first broken off at the weakened portion 36 from the forward extension 20 and is slipped on the forward extension 20 about which it rotates by passing the opening 30 of the propeller over the arrow head 32. The shoulder 34 will prevent the propeller from coming off of the extension 20 but will permit rotation of the propeller 22.

When the toy unit is mounted on the bicycle or tricycle any forward movement of said bicycle or tricycle will cause the propeller 22 to rotate and will provide an action toy.

The opposite sides 12 of the body 11 are flat and the body surfaces may be engraved with a comic character so that when same is molded, the face of said character is visible on the body. Likewise the opposite sides 21 of the extension 20 are flat and the extension 20 has the same width or thickness as the body portion 11.

Figure 2:
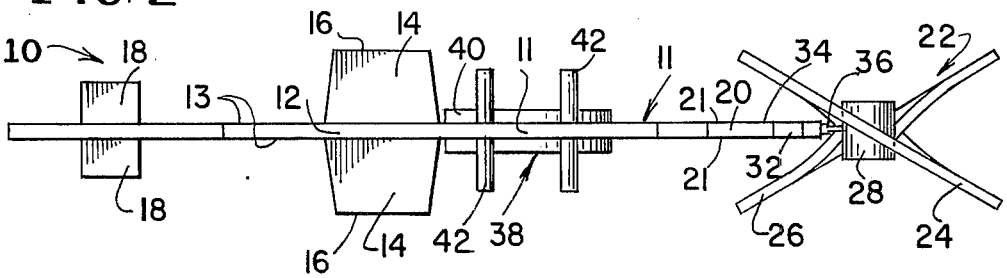
FIG. 2 is a top plan view of FIG. 1.
Figure 3:
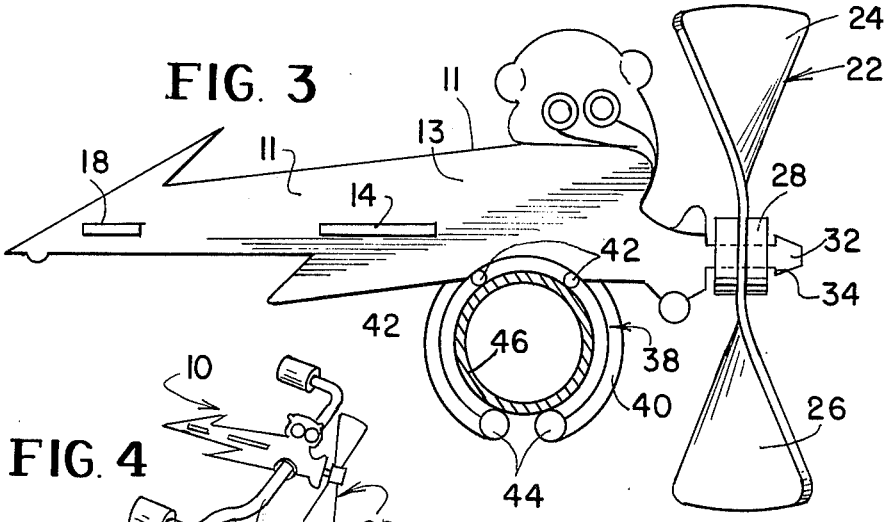
Figure 4:
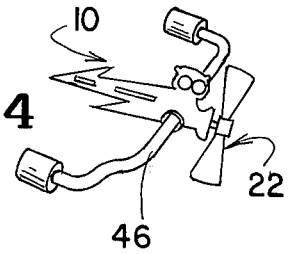
FIG. 4 shows same mounted on the handle bar of a tricycle or bicycle as in a position where it would be used.

The entire unit with the propeller is integrally molded as shown in FIGS. 1 and 2, and the propeller 22 with the oppositely angled blades when molded extends in the same plane as the body portion 11 with the opposite outer edges **24*a* and 26*a* respectively of the blades 24 and 26 extending in the same planes as the outer edges 16 of the wings 14. Thus, the angled blades 24 and 26 of the propeller 22 are readily molded with the body as an integral unit. The annular opening 30 is slightly larger than the height of the flat extensions 20 to permit the propeller to rotate on the extension 20**.

While the body is here shown to simulate an airplane, it will be understood that the body may be of any shape or of any design and need not be limited to airplanes.

However, irrespective of the design of the body, the propeller is integrally formed therewith and is detached therefrom to be mounted on the projection or extension about which it rotates.

A toy constructed in accordance with this invention is inexpensive as it utilizes very little plastic material and is integrally formed in an injection molding machine.

We claim:

1. A toy integrally molded of a plastic material and comprising a body portion, an extension at one end of said body portion and a propeller all molded as an integral unit, said propeller adapted to be detached from said unit and manually mounted on said extension for rotation on said extension, a ring-like member molded as part of the body portion and extending below said body portion to permit attachment of said toy to a support and the like.

2. A toy as set forth in claim 1 in which the body portion is formed to simulate a toy airplane with laterally extending fixed simulated wings.

3. A toy as set forth in claim 1 in which the ring-like member is a split ring to permit it to be snapped on the handle bar of a tricycle or bicycle.

4. A toy as set forth in claim 1 in which the extension is at the front end and in which the propeller as molded is adjacent the front of the extension with a weakened portion between the propeller and the extension so that it may be readily detached therefrom.

5. A toy as set forth in claim 1 in which the propeller is an integral part of said extension and is positioned generally in the same plane as the body portion when same is molded.

6. A toy as set forth in claim 1 in which the ring-like member has a thickness or width approximating that of the body portion and in which said ring-like member has lateral extensions so that when the ring-like member is mounted on a support the lateral extensions will prevent wobbling of the toy.

7. A toy as set forth in claim 5 in which the propeller has oppositely angled blades.

8. A toy as set forth in claim 5 in which the body portion is relatively thin and in which the blades of the propeller are angled and in which the propeller has a hub so that when detached from the extension it is positionable on said extension to rotate about with said extension and in which the extension has means to prevent the propeller from coming off of said extension when rotating.

9. A toy as set forth in claim 2 in which the propeller has angled blades and in which the opposite edges of the propeller blades are in substantially the same vertical plane as the opposite edges of the laterally extending wings.

10. A toy as set forth in claim 8 in which the connection between the extension and the propeller when molded is a weakened area so that manual twisting of said propeller will detach said propeller from said extension.

* * * * *